US006161225A

United States Patent [19]

Arai

[11] Patent Number: 6,161,225

[45] Date of Patent: Dec. 19, 2000

[54] SHIELD STRUCTURE OF HELMET

[76] Inventor: Michio Arai, c/o Arai Helmet, Ltd., 12, Azuma-cho 2-chome, Ohmiya-shi, Saitama-ken, Japan

[21] Appl. No.: 09/287,018

[22] Filed: Apr. 6, 1999

[30] Foreign Application Priority Data

Apr. 30, 1998 [JP] Japan ..... 10-121112

[51] Int. Cl.[7] ..... A42B 3/22

[52] U.S. Cl. ..... 2/424

[58] Field of Search ..... 2/424, 15, 10, 2/435, 6.3, 6.4, 6.5, 6.7

[56] References Cited

U.S. PATENT DOCUMENTS

| | | | |
|---|---|---|---|
| 4,047,249 | 9/1977 | Booth | 2/10 |
| 5,131,101 | 7/1992 | Chin | 2/424 |
| 5,161,261 | 11/1992 | Kamata | 2/424 |
| 5,671,483 | 9/1997 | Reuber | 2/424 |
| 5,765,235 | 6/1998 | Arnold | 2/424 |
| 5,890,233 | 4/1999 | Kaffka | 2/424 |

FOREIGN PATENT DOCUMENTS

| | | | |
|---|---|---|---|
| 2675348 | 10/1992 | France | 2/424 |
| 5834921 | 8/1956 | Japan . | |
| 63219609 | 9/1988 | Japan . | |
| 4131619 | 12/1992 | Japan . | |

*Primary Examiner*—Michael A. Neas
*Attorney, Agent, or Firm*—Dykema Gossett PLLC

[57] ABSTRACT

A shield for a helmet includes an inner shield and an outer shield which are fixed and held while their mutual sealing characteristics are positively assured and wherein the inner shield and the outer shield can be separated from each other. A shield 2 is removably attached to an outer side of an inner shield 1 attached in such a way that it can be freely turned in an upward or downward direction in respect to a helmet main body B through a resilient seal member 11 installed along a substantial outer circumference of a visual field range and concurrently a tension force for generating a force for press adhering the seal member 11 is applied to the shield 2 outside of it and then it is supported at the inner shield 1.

3 Claims, 4 Drawing Sheets

SHIELD STRUCTURE OF HELMET

BACKGROUND OF THE INVENTION

1. Field of the Invention

This invention relates to a shield structure of a helmet, and more particularly to a shield installed outside a front opening formed in a helmet.

2. Description of the Prior Art

As a shield installed on a helmet, a single sheet type synthetic resin plate (for example, a plate member of polycarbonate resin) is generally used. Such a shield is used to protect the face of a person wearing the helmet from blowing rain, wind, dust, insects and small stones or the like. When used in rain, the shield will be fully closed over the front opening in the helmet.

However, when the shield is used in a closed state, it can become fogged by the user's breath or by sweat caused by an increased temperature within the helmet or the like.

This shield misting condition is produced by a temperature difference across the shield, wherein due to this fact, as means for reducing the temperature difference across the shield, a ventilation means is utilized for taking surrounding atmosphere into the inside part of the helmet and directing the air along the inner surface of the shield, thereby its corresponding effects realized. However, this system provides a device for taking in the surrounding atmosphere into the helmet itself, resulting in the productivity or design of the helmet being affected. Due to this fact, it has been required to provide a shield capable of accomplishing a complete anti-misting situation only with the shield and without influencing the construction of the helmet.

As the anti-misting structure completely finished only with this shield, there has been provided an integral shield having a dual-structure.

The configuration is made such that a seal member is adhered and fixed along a substantial outer circumference of a visual range between an inner plate and an outer plate so as to form a closed space forming a heat insulated layer between the inner plate and the outer plate, wherein a temperature difference across the plates per one shield is reduced and an anti-misting against the inner plate of the shield is performed.

However, since the aforesaid anti-misting structure for the shield is made such that an inner plate and an outer plate are adhered to each other and assembled integrally to form a closed space, it is hard to keep its durability while assuring an air-tightness by holding a desired curve and its manufacturing cost is also high due to the aforesaid form. In addition, in the case that a seal member for use in forming a closed space between the inner plate and the outer plate is deteriorated to cause the air-tightness to be damaged due to damage or the like, it is impossible to perform a partial replacement of the member to return it to have an initial function and there may be provided a disadvantage that the entire assembly must be broken to replace the broken assembly with a new shield. Further, in order to improve an effect of anti-misting state in response to a surrounding circumstances, it is also impossible for a user by himself or herself to apply an anti-misting processing such as a coating of surface active agent or the like at both inside part of the outer plate and outside part of the inner plate.

SUMMARY OF THE INVENTION

The present invention has been invented in view of the aforesaid problems found in the prior art and it is an object of the present invention to provide a shield for a helmet in which an inner shield and an outer shield are fixed and held while their mutual sealing characteristics are being assured and at the same time the inner shield and the outer shield can be separated from each other.

The technical means provided by the present invention to solve the aforesaid problems is characterized in that a dual structure is comprised of an inner shield for fixing a shield to a helmet in such a way that it may be rotated in an upward or downward direction and an outer shield supported in a specified space outside the inner shield, a seal member is arranged and fixed between the aforesaid inner shield and the aforesaid outer shield along a substantial outer circumference of a visual field range of a forward opening of the helmet so as to form a heat insulated air layer inside the seal member, a supporting means for applying a tension force for generating a force to press against the aforesaid seal member to the outer shield and supporting it is installed at the inner shield and they can be separated from each other.

The aforesaid visual field range has a maximum range in which a forward visual confirmation is not prohibited, for example, a substantial same range as that of a front surface opening formed at a full-face type helmet is made to be maximum. In addition, in the case of the shield in an open face type helmet, it is defined as the same range as that of the shield used in the aforesaid full-face type helmet.

The inner shield and the outer shield constituting a shield are constituted by a plate member made of polycarbonate resin and as the seal member arranged between the inner shield and the outer shield, foamed rubber or the like is used. Then, although the seal member may be fixed to any one of an outer surface of the inner shield or the inner surface of the outer shield, in the case that application of the single inner shield after separating the outer shield is considered, it may be satisfactory to fix it to the inner surface of the latter outer shield.

In addition, the supporting means for the aforesaid outer shield may be arranged at arms fixed to or removed from the helmet and connected and fixed to both right and left sides of the inner shield or arranged at the outer surfaces of the right and left sides of the inner shield which is removably supported against the helmet.

As the supporting means arranged at the arms, for example, the supporting means can be comprised of engaging protrusions projected and formed at the inner surfaces of the arms connected and fixed while the outer shield insertion space being assured on the outer surfaces of the right and left sides of the inner shield and the engaging holes formed at the outer shield removably engaged with the engaging protrusions. Then, as the form of the engaging protrusion, it is possible to apply a tapered protrusion riding over the shield in the outer shield inserting direction and engaged with the shield in the outer shield pulling-out direction.

Further, the inner shield is heated and bent to be closely contacted with an edge forming rubber fixed to an eye port trim of a front opening (a window hole) of the helmet, or an injection molded shield is applied, and to the contrary, the outer shield is heated and bent to have a shape in which its rate of curvature is set to be at least equal to or loosened less than that of the inner shield, or an injection molded shield or a flat plate-like shield is applied, the outer shield is closely contacted along the outside part of the aforesaid inner shield, engaged with and held by it. Accordingly, since the outer shield is bent along the inner shield, it is convenient to use the shield of which wall thickness is thinner than that of the inner shield.

In addition, the shield to which the present invention belongs is not limited to the seal installed at a full-face type helmet, but includes a shield to be installed in an open face type helmet.

In accordance with the aforesaid means, since the shield is formed with a tight-closed space of heat-insulated air layer between the inner shield and the outer shield, the shield is prevented from being misted under an action of the tight-closed space. Then, since the outer shield constituting a shield is constructed such that the outer shield can be separated from the inner shield, when either one of the inner shield and the outer shield is scratched or damaged or when the seal material fixed to any one of the inner shield or the outer shield is deteriorated or damaged, it is possible to recover to its initial state only with replacement of the corresponding member. Additionally, it is also facilitated to apply an anti-misting processing such as coating of a surface active agent at an inner side surface of the outer shield and an outer side surface of the inner shield in order to improve an anti-misting effect as required.

DETAILED DESCRIPTION OF THE PREFERRED EMBODIMENT

Figure 1:
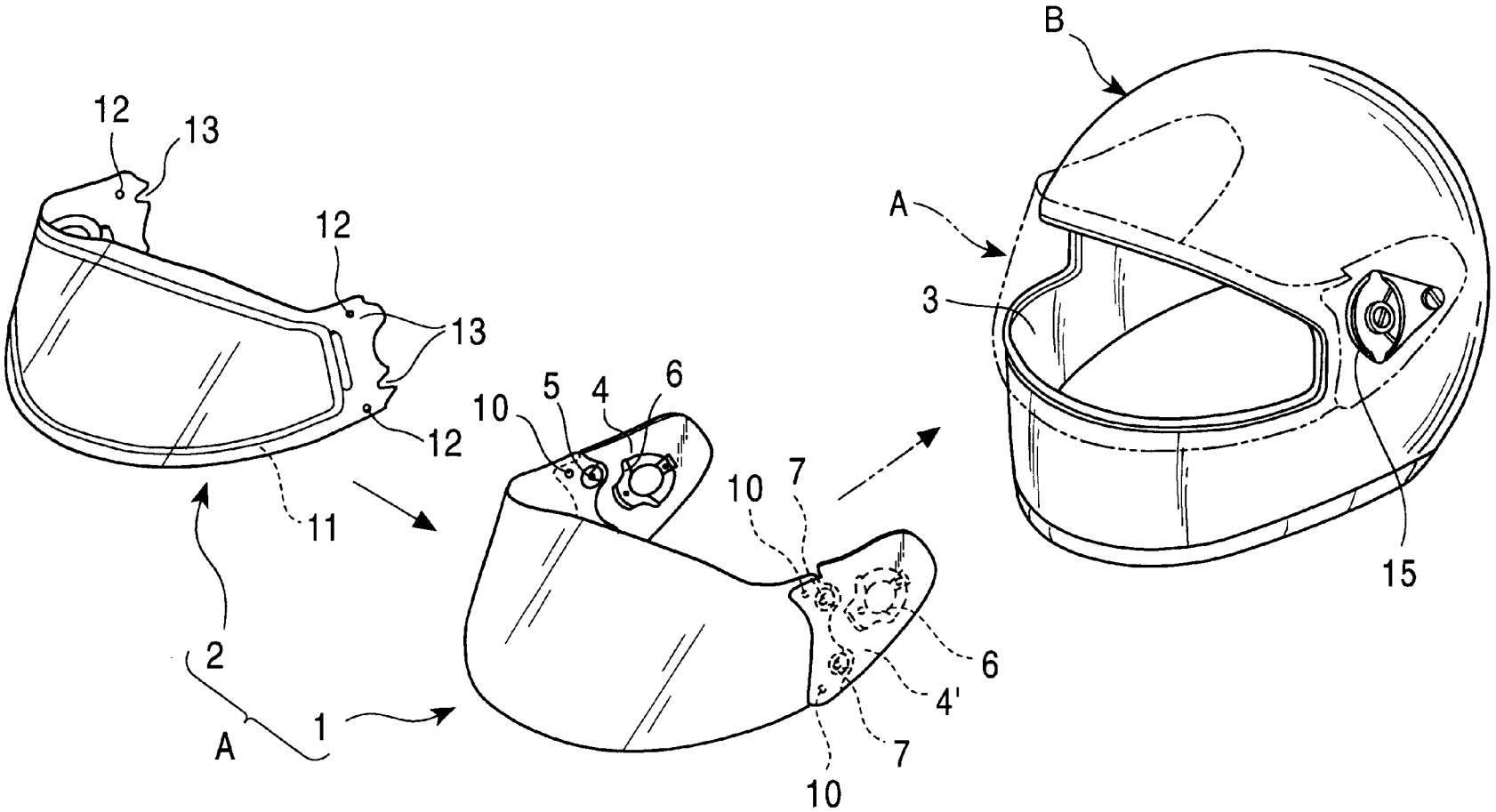
FIG. 1 is an exploded perspective view of a helmet and a shield in accordance with a preferred embodiment of the present invention.
Figure 2:
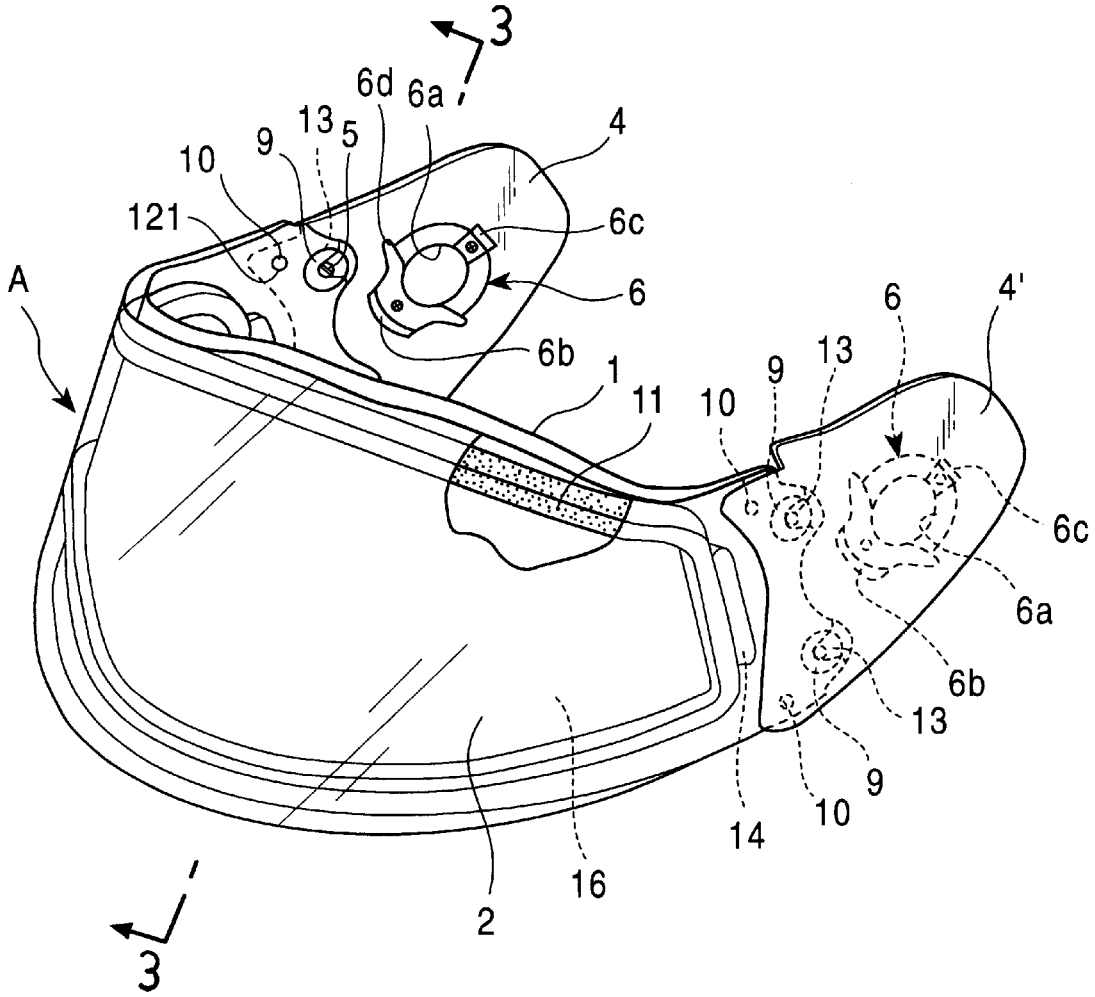
FIG. 2 is a perspective view of the shield with a part thereof broken away.

Referring now to the drawings, one preferred embodiment of the present invention will be described.

In FIG. 1, which shows a preferred embodiment of the present invention, a shield A, which is formed of an inner shield 1 and an outer shield 2, is attached to a full faced type helmet B so as to be in front of a forward opening (a window hole) 3 in such a way that it may be rotated in an upward or downward direction and it can be removably installed. Although the outer shield 2 of the shield A is a linear flat plate before it is assembled on the inner shield 1, in FIG. 1 it is shown in a state in which it is supported outside the inner shield 1.

The inner shield 1 is made such that a plate member of polycarbonate resin is "heated and bent" and arms 4, 4' having engagement members 6 to be engaged with or detached from hook members 15 fixed to the right and left side surfaces of the helmet B are connected to and fixed to both right and left sides with a screw 5.

Figure 3:
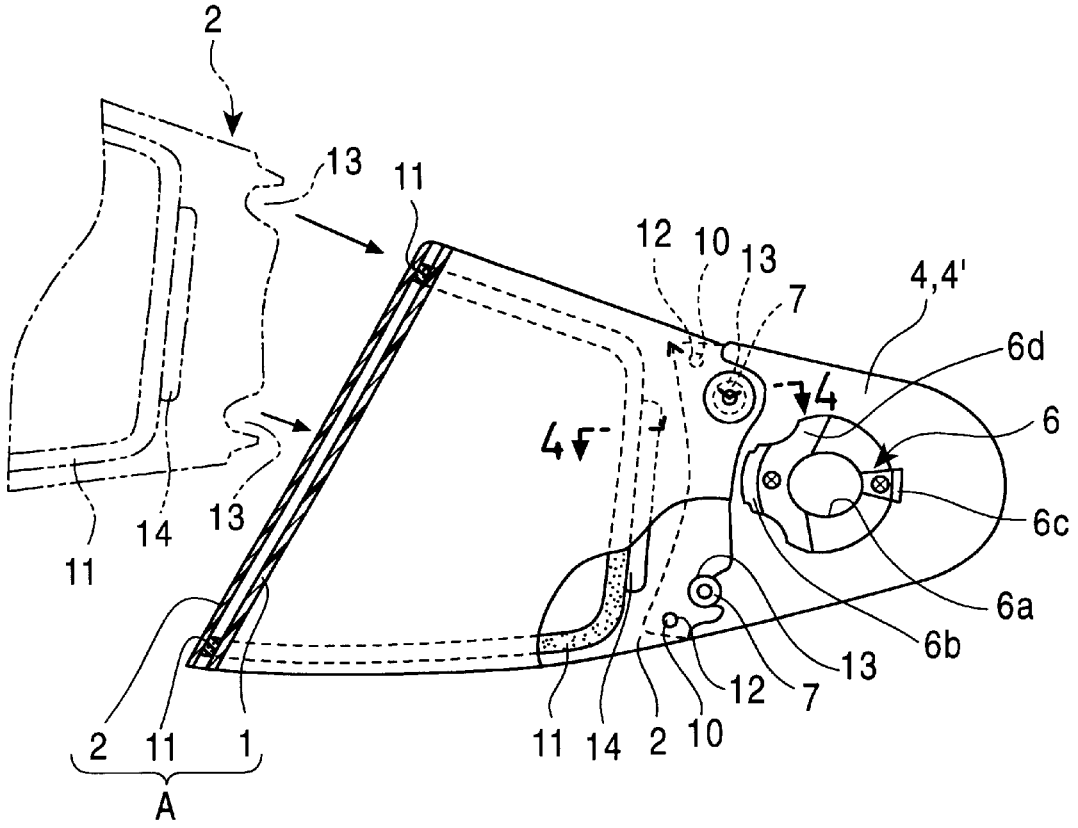
FIG. 3 is a sectional view taken along line 3—3 of FIG. 2 with part of the shield being broken away.
Figure 4:
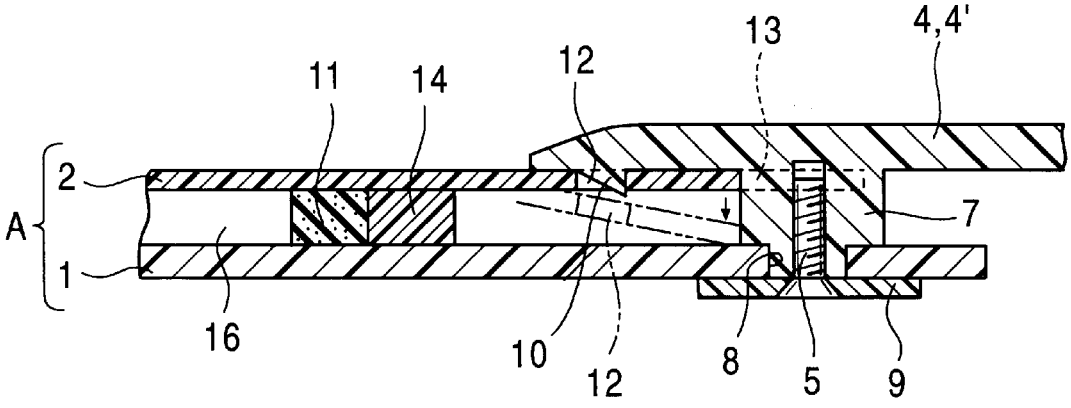
FIG. 4 is an enlarged sectional view taken along a line 4—4 of FIG. 3.

As shown in FIGS. 3 and 4, connecting and fixing of the inner shield 1 with the arms 4, 4' are carried out such that stepped shafts 7 are integrally projected at the upper part and the lower part of the inner surface of each of the arms 4, 4', fixing holes 8 formed at an upper part and a lower part of the right side end and the left side end of the inner shield 1 are fitted to the stepped shaft 7 and concurrently the screw 5 is threadably fitted to the stepped shaft 7 through a washer 9 and fixed there. Engaging protrusions 10 constituting the supporting means for engaging with and holding the outer shield 2 are projected and formed around the stepped shafts 7 at the upper part and the lower part in the inner surface of each of the arms 4, 4' and in front of a fixing and inserting direction of the outer shield 2 to be described later and at the same time the engaging protrusions 10 are formed into tapered protrusions (having a triangle sectional surface) which the outer shield 2 rides over when it is inserted and engages with it when the outer shield 2 is pulled out.

The stepped shafts 7 formed at the arms 4, 4' may act as position setting members not only for fixing the inner shield 1 while assuring the inner surfaces of the arms 4, 4' and a space into which the outer shield 2 to be described later is inserted, but also for engaging and holding the outer shield 2 to be inserted at a predetermined position.

The outer shield 2 curved along an outside part of the aforesaid inner shield 1 and fixed is cut and formed to be along with an outer shape of the inner shield 1 by applying a thinner plate member of polycarbonate resin than that of the inner shield in the same manner as that of the inner shield 1, wherein to one side surface of the plate member is adhered and fixed a belt-like resilient seal member 11 in such a shape as one substantially coinciding with the shape of the front opening (a window hole) 3 in the helmet B.

Then, each of the upper part and the lower part of the right side and the left side of the outer shield 2 is formed with an engaging hole 12 of the supporting means removably engaged with the engaging protrusions 10 of the supporting means formed at the arms 4, 4' connected to and fixed to the right side and the left side of the aforesaid inner shield 1 and with hook recesses 13 engaged with the stepped shafts 7, respectively.

In addition, to the right and left sides of the surface having the resilient member 11 of the outer shield 2 adhered and fixed thereto are fixed spacers 14 made of relatively hard resilient material positioned outside the seal member 11 and having substantially the same height as that of the seal member 11.

Additionally, to the rear position from the fixing part of the inner shield 1 at the inner surfaces of the aforesaid arms 4, 4' are fixed with screws the engaging members 6 engaged with or disengaged from the hook members 15 constituting hook mechanisms fixed to the right and left side surfaces of the helmet B.

Figure 5:
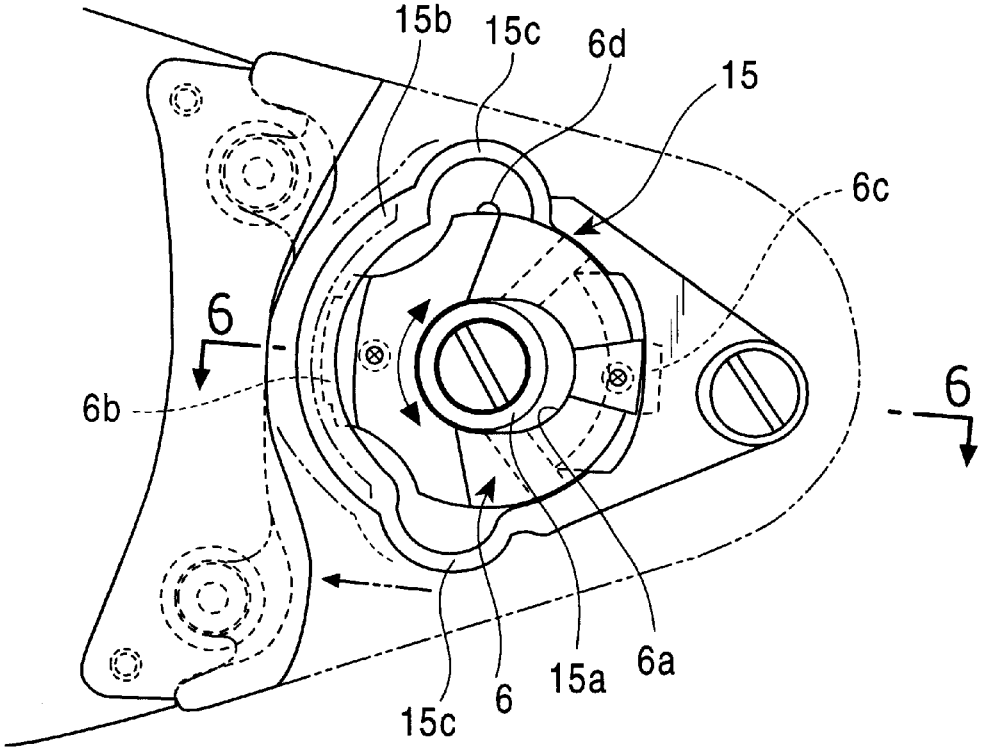
FIG. 5 is a front elevational view showing a hook mechanism for engaging and supporting the shield on a helmet.
Figure 6:
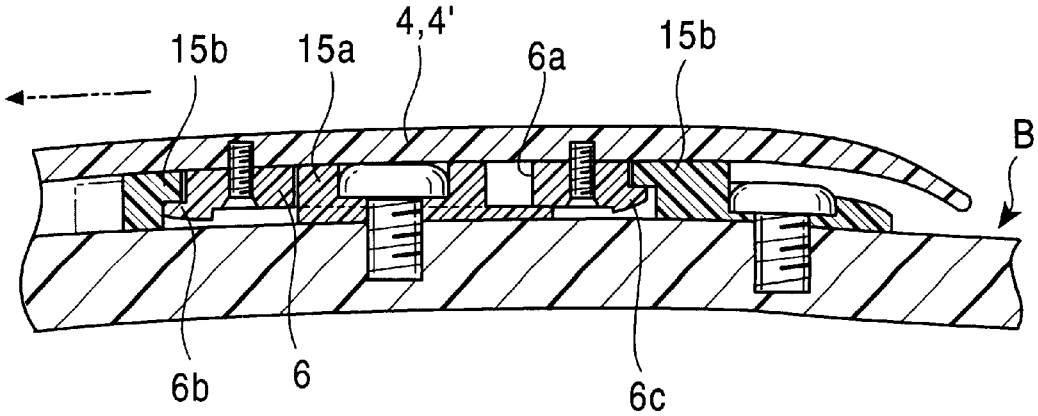
FIG. 6 is an enlarged sectional view taken along line 6—6 of FIG. 5.

The hook mechanism will be described in reference to FIGS. 5 and 6, wherein each of the hook members 15 fixed to the right and left side surfaces of the helmet B is constituted by a supporting shaft 15*a* made of synthetic resin material and a hook ring 15*b* formed outside the supporting shaft 15*a*, and the hook ring 15*b* is formed with a deformation part 15*c* at its part of outer circumference for realizing a spring action for generating a fixing and deformation.

In turn, each of the engaging members 6 fixed to the inner surfaces of the arms 4, 4' of the shield A is made of synthetic resin and formed into an ellipse shaped plate, the supporting shaft 15*a* of the hook member 15 is fitted to its central part and at the same time it is formed with an elliptical hole 6*a* enabling a pulling-out motion of it for engaging or disengaging of the shield A, engaging protrusions 6*b*, 6*c* engaged with the aforesaid hook ring 15*b* are formed at an outer circumferential edge on a long diameter line extending along a shield pulling-out direction, and a stopper 6*d* for preventing the shield A from being disengaged from the helmet B under a closed state is formed at an outer circumferential edge at a substantial intermediate position between the aforesaid engaging protrusions 6*b*, 6*c*.

When the shield A, constructed as described above, is installed in the helmet B, the engaging members 6 of the arms 4, 4' are aligned on the hook member 15 and pushed against the helmet B, resulting in that the hook ring 15*b* being pushed wide in a radial direction and the engaging protrusions 6*b*, 6*c* entering below the hook ring 15*b* so as to accomplish its hooked state.

In turn, when the shield A is removed from the helmet B, the shield A is turned upwardly from its full-closed state, the stopper 6*d* of the engaging member 6 is removed from the hook ring 15*b* of the hook member 15, wherein at this position, the arm is pulled in its drawing direction, the engaging protrusion 6*c* engaged with the hook ring 15*b* is removed and then the arm is pushed into an inserting direction to cause the engaging protrusion 6*b* to be removed from the hook ring 15*b*, resulting in that the arm of the shield A being removed from the helmet B.

Then, engaging or disengaging between the inner shield 1 and the outer shield 2 constituting the shield A will be described, wherein when the outer shield 2 is fixed to the outside part of the inner shield 1, at first one end of the outer shield 2 is inserted into either the arm 4 or the arm 4' connected to the side part of the inner shield 1, the hook recess 13 is engaged with the stepped shaft 7 and concurrently the engaging hole 12 is fitted and engaged with each of the engaging protrusions 10 and hooked and fixed. Then, the other end of the outer shield 2 is inserted into another arm while the outer shield 2 is pushed against the surface of the inner shield 1, each of the hook recess 13 and the engaging hole 12 is engaged from each other and fixed to complete the shield A. Under this completed state, the seal member 11 adhered to the inner surface of the outer shield 2 is closely contacted with the outer surface of the inner shield 1, thereby a closed space 16 acting as a thermal insulated air layer is defined and formed between the inner shield 1 and the outer shield 2. The shield A is prevented from being fogged under an action of the thermal insulated air layer in the closed space 16.

In addition, when the outer shield 2 is separated from the inner shield 1, the upper part and the lower part near the arm rather than the spacer 14 at the outer shield 2 are pushed down to the inner shield 1, resulting in the engaging hole 12 being moved away from the inner surface of the arm, thereby the engaging hole 12 is removed from each of the engaging protrusions 10 and can be pulled out of the arm. The aforesaid operation is also carried out for the other side to enable the outer shield 2 to be easily separated from the inner shield 1.

Accordingly, when the seal member fixed to the outer shield is deteriorated or damaged, only the outer shield is replaced with a new one to enable it to be returned to its original state. In addition, when it is not necessary to perform an anti-misting operation with the aforesaid thermal insulated air layer, the outer shield 2 is removed by the aforesaid operation and the helmet may be used only with the inner shield.

The shield structure of the present invention can assure durability while keeping an air-tightness between the inner shield and the outer shield, and at the same time the shield of dual structure having the thermal insulated air layer can be easily manufactured with the described configuration Then, since the outer shield can be separated from the inner shield, even when the seal member is deteriorated to cause air-tightness to be damaged, only the shield having the aforesaid seal member fixed thereto is replaced with a new one to enable it to return to its initial state, and this system is quite convenient in use. In this case, a troublesome handling in manufacturing step can be saved more than the case of an integral type of the existing outer shield and the inner shield or it is not necessary for the outer shield to fulfill the same degree of condition as that of the inner shield, resulting in that its corresponding manufacturing cost can be restricted. In addition, it is also facilitated to perform an anti-misting processing such as coating of surface active agent or the like against the inside surface of the outer shield and the outside surface of the inner shield in order to improve an anti-misting effect as required.

Further, it is also possible to use as the outer shield an item colored in light color or raw material for preventing ultraviolet ray and in this case, it is possible to eliminate the need for the user to put on sunglasses inside the helmet during a day time in the summer and facilitate more easy than that installing of the helmet.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A shield structure for attachment to a helmet body so as to be rotatable between an upper position and a lower position relative to a front opening in the helmet body, said shield structure comprising:

an inner shield member which defines opposite first and second sides, an outer shield member which defines opposite first and second sides that correspond with said first and second sides of said inner shield member, said outer shield including a plurality of openings in said first side thereof, a spacer member which is positioned between said inner and outer shield members, a seal member located between said inner and outer shield members and within said spacer member to define a sealed air space therebetween, and an arm member which is removably attachable to a hook member on one side of said helmet body, said arm member being attached to said first side of said inner shield member and including a plurality of engaging projections which are extendable in respective said openings in said first side of said outer shield member to removably connect said outer shield member to said arm after said outer shield member has been bent at said first side thereof and outwardly of said spacer member so as to fit within said engaging projection.

2. A shield structure according to claim 1, wherein said inner shield includes a fixing hole in a first side thereof, wherein said arm member includes a stepped shaft having an end position that fits within said fixing hole, and a screw with washer which attaches said inner shield to said stepped shaft.

3. A shield structure according to claim 1, wherein said engaging protrusions are tapered and allow the outer shield member to slide thereover when the outer shield member is inserted within the arm and lock the outer shield in position when engaged in the openings therein.

* * * * *